US007753368B2

(12) United States Patent
Sekiyama et al.

(10) Patent No.: US 7,753,368 B2
(45) Date of Patent: Jul. 13, 2010

(54) SHEET PROCESSING APPARATUS AND IMAGE FORMING APPARATUS PROVIDED WITH THE SAME

(75) Inventors: Junichi Sekiyama, Tokyo (JP); Masayoshi Fukatsu, Suntou-gun (JP); Atsushi Ogata, Mishima (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 12/017,732

(22) Filed: Jan. 22, 2008

(65) Prior Publication Data

US 2008/0179821 A1 Jul. 31, 2008

(30) Foreign Application Priority Data

Jan. 26, 2007 (JP) ..... 2007-015798
Jan. 18, 2008 (JP) ..... 2008-008741

(51) Int. Cl.
*B65H 31/00* (2006.01)

(52) U.S. Cl. ..... 271/207; 271/218; 271/220; 270/58.12; 270/58.14; 270/58.16; 270/58.17; 270/58.11

(58) Field of Classification Search ..... 271/207, 271/218, 220; 270/58.08, 58.11, 58.12, 58.14, 270/58.16, 58.17
See application file for complete search history.

(56) References Cited

U.S. PATENT DOCUMENTS 5,552,875 A * 9/1996 Sagiv et al. ..... 399/364
5,909,871 A * 6/1999 Takehara ..... 270/58.07
5,931,460 A * 8/1999 Kadowaki et al. ..... 271/220
6,042,098 A * 3/2000 Kubota et al. ..... 270/58.02
6,290,220 B1 9/2001 Takehara et al. ..... 270/58.12
6,318,718 B1 11/2001 Ogata et al. ..... 271/213
6,325,371 B1 12/2001 Araki et al. ..... 271/297
6,382,616 B1 5/2002 Waragai et al. ..... 270/58.12
6,398,203 B1 * 6/2002 Saito et al. ..... 270/58.12
6,450,492 B1 * 9/2002 Coombs et al. ..... 270/58.08
6,561,503 B1 5/2003 Ogata et al. ..... 270/58.12
6,661,995 B2 12/2003 Isobe et al. ..... 399/410
6,733,007 B2 5/2004 Sekiyama et al. ..... 271/65

(Continued)

FOREIGN PATENT DOCUMENTS

JP 4-128096 4/1992

(Continued)

*Primary Examiner*—Patrick Mackey
*Assistant Examiner*—Luis Gonzalez
(74) *Attorney, Agent, or Firm*—Fitzpatrick, Cella, Harper & Scinto

(57) ABSTRACT

A sheet processing apparatus comprises: an first stack portion which temporarily stacks a sheet thereon; a first stack portion which is disposed under the first stack portion and stacks thereon a sheet discharged from the first stack portion; a second stack portion which is disposed above the first stack portion and stacks a sheet thereon; a stack reference wall which serves as an abutment reference at an end of the sheet on the second stack portion; and an alignment reference wall which is disposed more upstream in the sheet conveyance direction than the stack reference wall and serves as an abutment reference at an end of the sheet on the first stack portion; wherein the second stack portion has such a length that an end of the sheet stacked on the first stack portion cannot project from the second stack portion, as viewed from above in a vertical direction.

24 Claims, 11 Drawing Sheets

U.S. PATENT DOCUMENTS

| | | | | |
|---|---|---|---|---|
| 6,973,285 | B2 | 12/2005 | Sekiyama et al. | 399/367 |
| 6,997,456 | B2 | 2/2006 | Fukatsu et al. | 271/306 |
| 7,258,339 | B2 * | 8/2007 | Fukatsu et al. | 271/220 |
| 2005/0189690 | A1 | 9/2005 | Kuwata et al. | 270/58.08 |

FOREIGN PATENT DOCUMENTS

| | | |
|---|---|---|
| JP | 2005-280856 | 10/2005 |

* cited by examiner

SHEET PROCESSING APPARATUS AND IMAGE FORMING APPARATUS PROVIDED WITH THE SAME

BACKGROUND OF THE INVENTION

1. Field of the Invention

The present invention relates to a sheet processing apparatus which can selectively process a sheet received from a main body of an image forming apparatus and, more particularly, to a sheet processing apparatus having a plurality of stacks which stack sheets thereon.

2. Description of the Related Art

Some of conventional image forming apparatuses such as copying machines or printers are provided with a sheet processing apparatus which can sequentially receives sheets, each having an image formed thereon, and then, selectively subjects the sheets to a binding process. A sheet processing apparatus disclosed in, for example, Japanese Patent Application Laid-open No. 4-128096 is of a console type installed directly on a floor. At an upper portion of such a sheet processing apparatus are arranged a plurality of elevatable stack trays for assorting sheets. Inside of a body at a lower portion of the apparatus is housed a sheet processing portion having a stapling function in a vertical direction. A sheet received from a main body of the image forming apparatus is separately conveyed onto either one of upper and lower conveying paths by a switching member. The sheet conveyed above is separately stacked on the elevatable stack tray. In contrast, the sheet conveyed downward passes through a lower U-shaped path, on which the sheet is oriented upward at the tip thereof, and then, is conveyed onto an intermediate stack portion vertically housed inside the body of the apparatus. The sheets conveyed onto the intermediate stack portion are bound together after alignment. Thereafter, the bundle of sheets is pushed up at the rear end thereof by a belt member, to be then discharged to a discharge tray.

However, since the sheet processing portion including the intermediate stack portion in the conventional sheet processing apparatus disclosed in Japanese Patent Application Laid-open No. 4-128096 is configured in the vertical direction on an apparatus installation plane, the apparatus is increased in vertical size.

In order to miniaturize the vertical size of the sheet processing apparatus, it is construed that a distance between the intermediate stack portion and the stack tray disposed above the intermediate stack portion is reduced as possible. However, since the intermediate stack portion is configured in the vertical direction, as described above, the mere reduction of the distance causes the tip of the sheet to enter under the upper stack tray when the sheet is discharged from the intermediate stack portion, thereby raising an accident of jamming. In view of this, it is necessary to form a clearance between the intermediate stack portion and the upper stack tray enough to prevent the sheet from being jammed, thereby making it difficult to miniaturize the apparatus.

Furthermore, in order to miniaturize the vertical size of the sheet processing apparatus, it is construed that the intermediate stack portion is disposed in a lateral direction along the upper stack tray. However, a mere proximity between the intermediate stack portion and the upper stack tray possibly causes an accidental touch to the sheet being aligning on the intermediate stack portion or erroneous withdrawal of the sheet when a user accesses the sheet on the stack tray.

SUMMARY OF THE INVENTION

In view of the above, an object of the present invention is to provide a sheet processing apparatus in which an erroneous access to a sheet on an intermediate stack portion as a first stack portion can be reduced while the apparatus can be miniaturized.

In order to achieve the above-described object, a sheet processing apparatus according to the present invention comprises: a first stack portion which stacks thereon a conveyed sheet with one end of the sheet abutting against a first abutment reference; and a second stack portion which is disposed right above the first stack portion in a vertical direction and stacks a conveyed sheet thereon with one end of the sheet abutting against a second abutment reference, wherein the first abutment reference is disposed such that the first abutment reference project from a vertical line passed through the second abutment reference.

And in order to achieve the above-described object, a sheet processing apparatus according to the present invention comprises: a first stack portion which stacks thereon a conveyed sheet; and a second stack portion which is disposed right above the first stack portion in a vertical direction and stacks the conveyed sheet thereon, the second stack portion having such a length that an end of the sheet having a maximum length to be stacked on the first stack portion downstream in the sheet conveyance direction cannot project from a vertical line passed through an end of the second stack portion downstream in the sheet conveyance direction.

According to the present invention, the first stack portion and the second stack portion can be disposed in the proximity of each other, thus achieving the miniaturization of the apparatus. Furthermore, the sheet of a maximum length stacked on the first stack portion can be concealed from the second stack portion, as viewed from above in the vertical direction, even if the length of the second stack portion in the sheet conveyance direction cannot be made greater than necessary. Thus, it is possible to reduce an erroneous access to the sheet stacked on the first stack portion while achieving the miniaturization of the apparatus.

Further features of the present invention will become apparent from the following description of exemplary embodiments (with reference to the attached drawings).

DESCRIPTION OF THE EMBODIMENTS

Detailed descriptions will be illustratively given below of preferred embodiments according to the present invention in reference to the attached drawings. Incidentally, it is to be understood that the dimensions, materials and shapes of constituent parts described below in the preferred embodiments and relative arrangements therebetween should be appropriately varied according to configurations of apparatuses, to which the present invention is applied, or various conditions. As a consequence, the scope of the present invention is not limited to those in the embodiments, unless otherwise stated in particular.

First Embodiment

Figure 1:
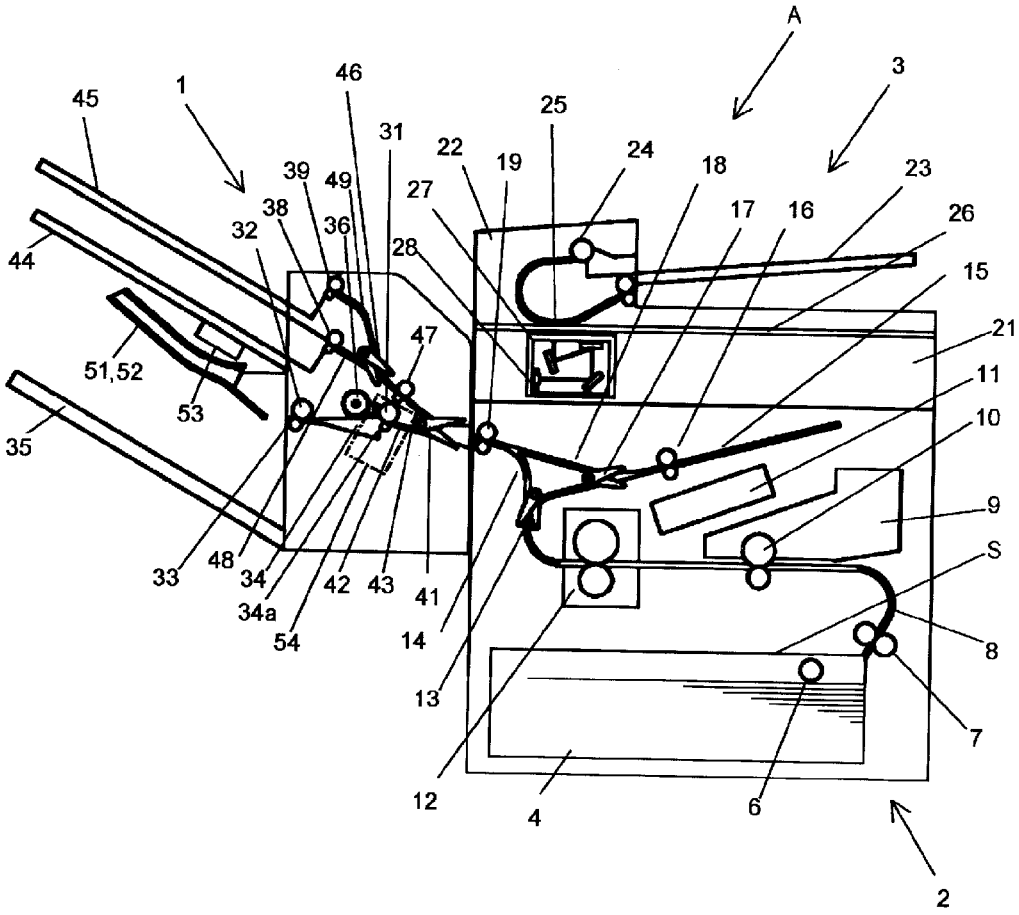
FIG. 1 is a schematic cross-sectional view most clearly showing essential parts of an image forming apparatus provided with a sheet processing apparatus.
Figure 2:
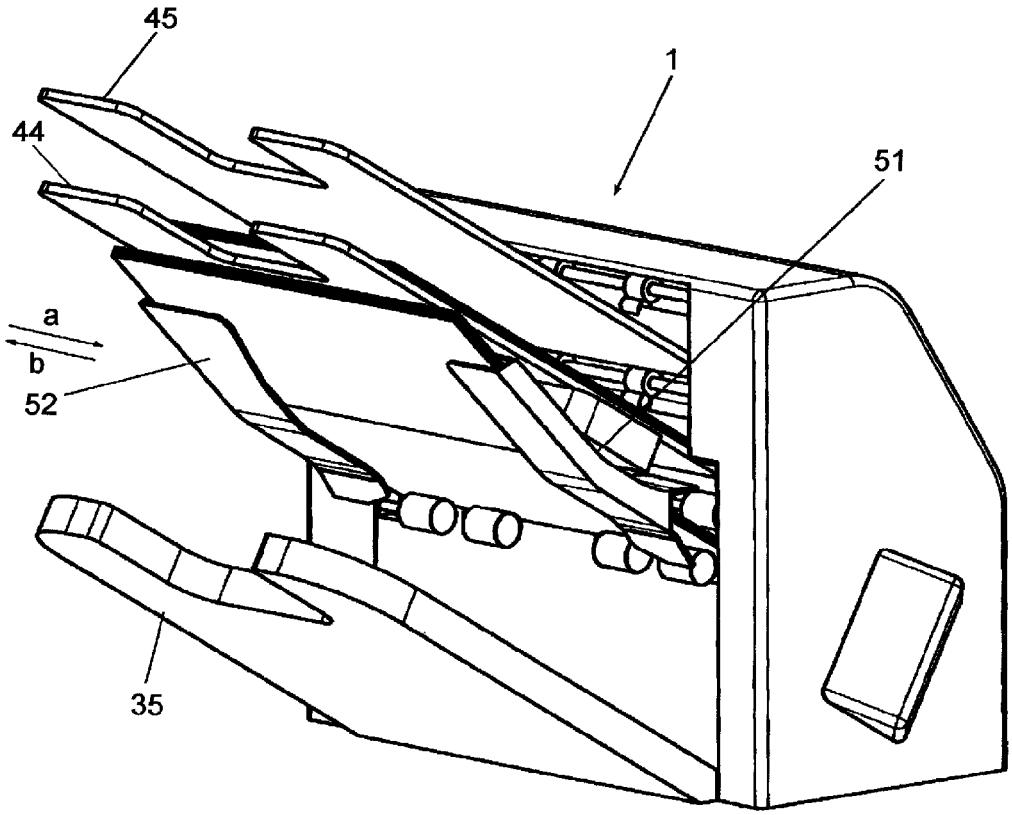
FIG. 2 is a perspective view showing a sheet processing apparatus in a first embodiment.
Figure 3:
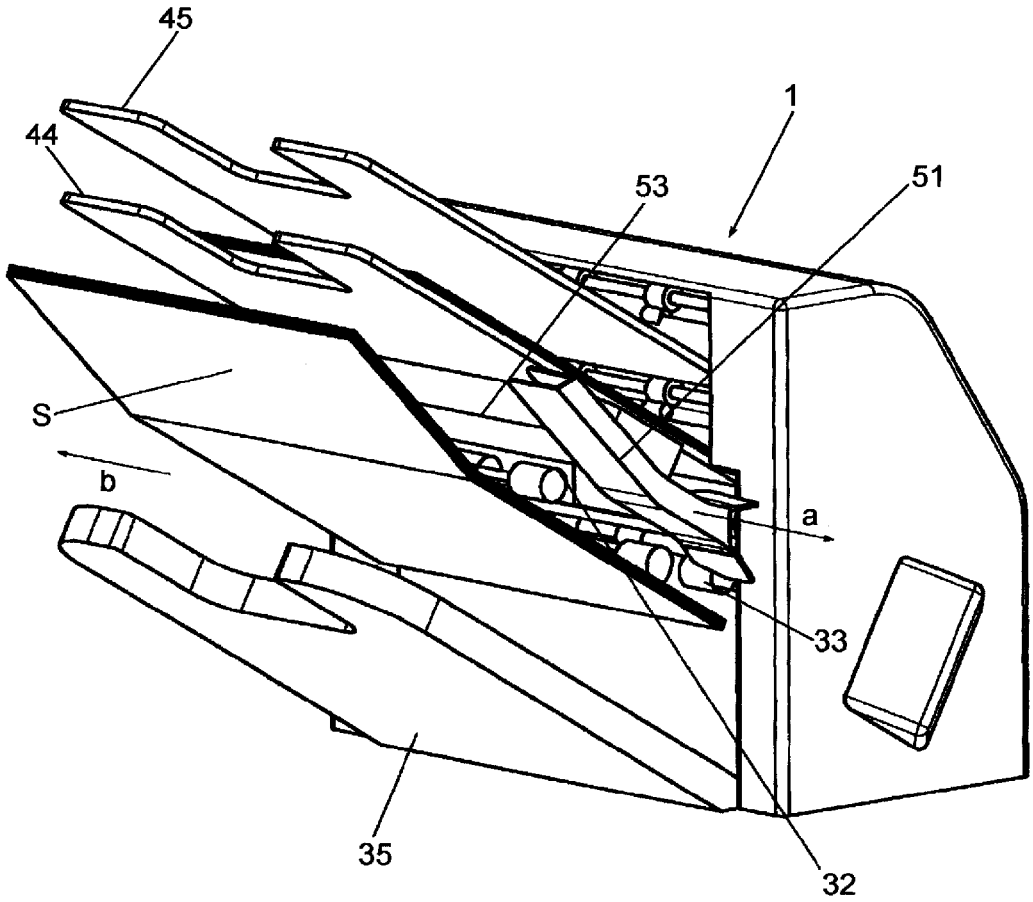
FIG. 3 is a perspective view showing the sheet processing apparatus in the first embodiment.
Figure 4:
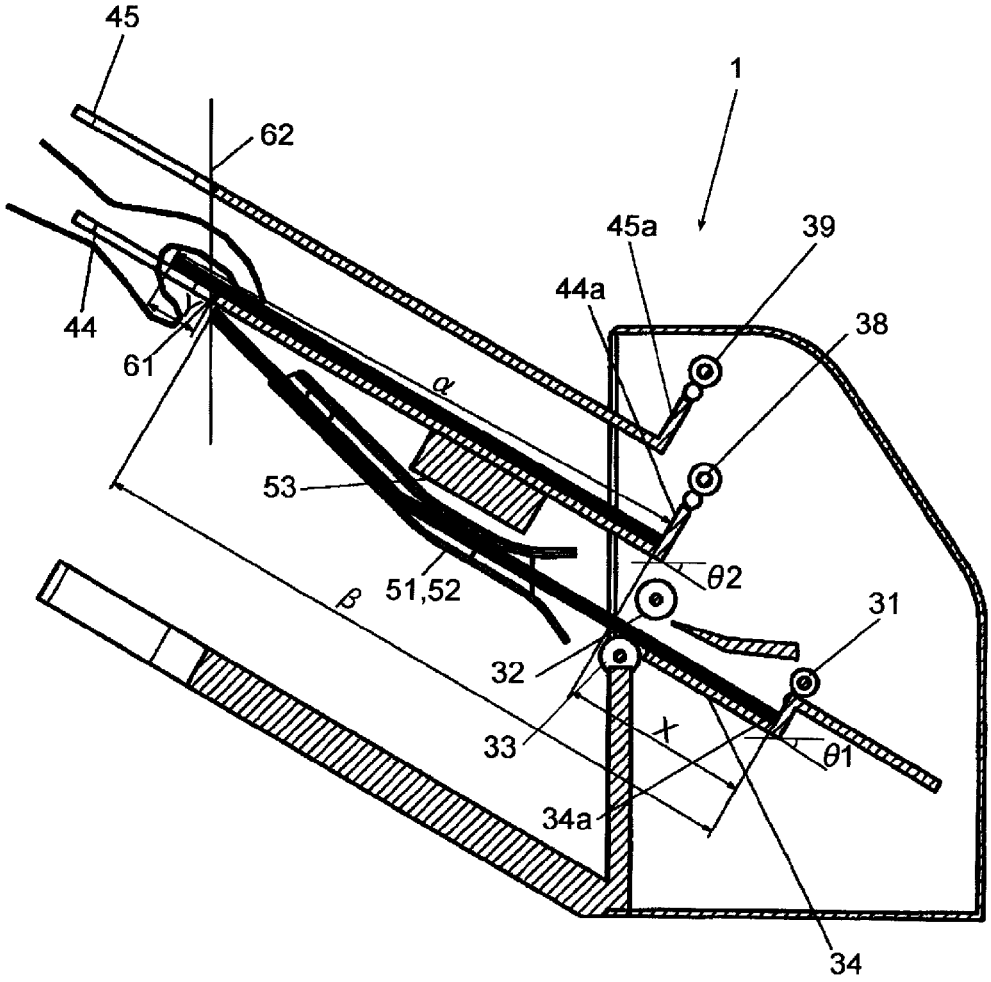
FIG. 4 is a schematic cross-sectional view showing the sheet processing apparatus in the first embodiment.
Figure 5:
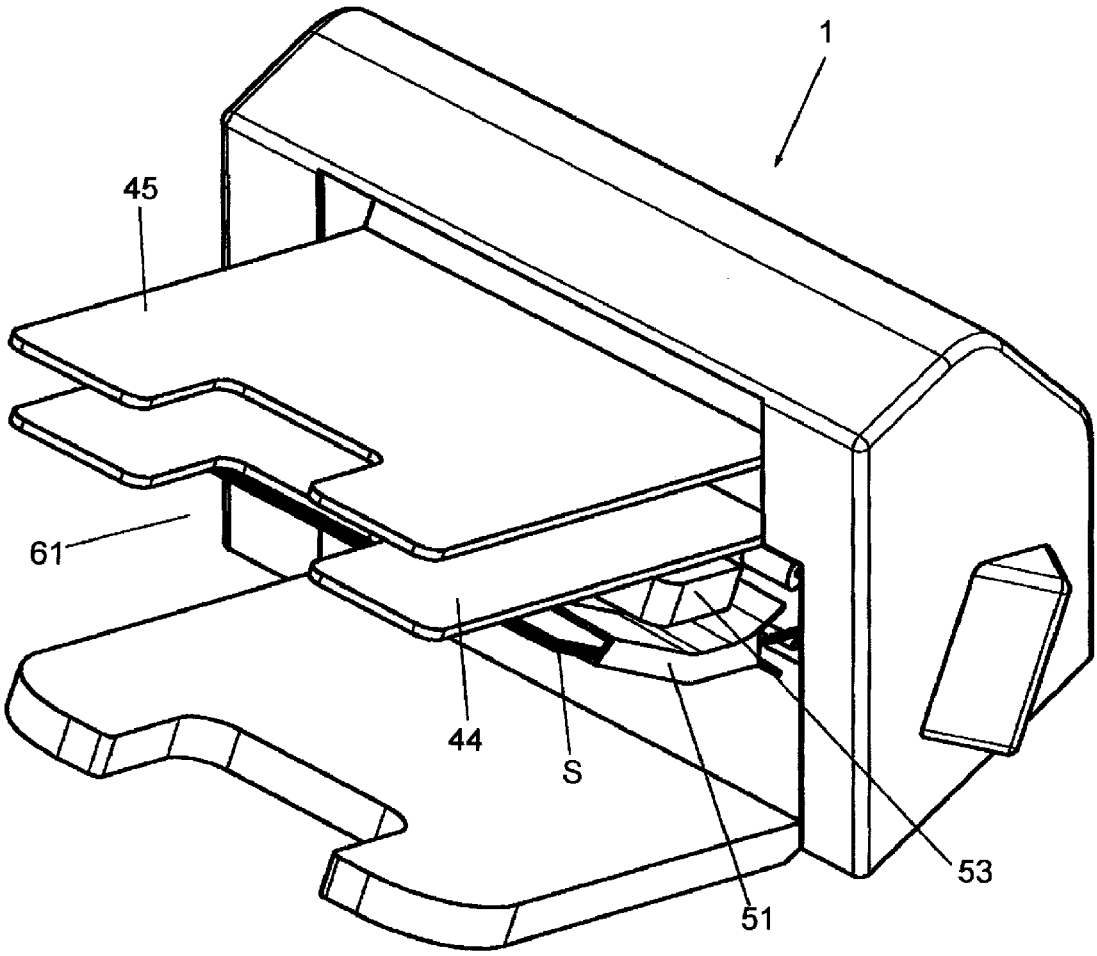
FIG. 5 is a perspective view showing the sheet processing apparatus in the first embodiment.

First of all, a schematic configuration of an image forming apparatus provided with a sheet processing apparatus in a first embodiment will be described below in reference to FIGS. 1 to 5. FIG. 1 is a cross-sectional view most clearly showing essential parts of an image forming apparatus provided with a sheet processing apparatus. FIGS. 2 and 3 are perspective views showing the sheet processing apparatus in the first embodiment. FIG. 4 is a schematic cross-sectional view showing the sheet processing apparatus in the first embodiment. FIG. 5 is a perspective view showing the sheet processing apparatus in the first embodiment.

As shown in FIG. 1, a sheet processing apparatus 1 in the first embodiment is detachably attached to a main body A of an image forming apparatus, for selectively performing predetermined processing such as stapling with respect to a sheet having an image formed thereon. Here, although a stapler (i.e., a binding unit) is illustrated as a processing unit for performing the processing with respect to the sheet, it is not limited to this. For example, there may be used other processing units such as a punching unit for punching a sheet or a folding unit for folding a sheet, or an appropriate combination of these units. The main body A of the image forming apparatus includes an image forming portion 2 which forms an image on a sheet, and an image reading portion 3 which is connected to the image forming portion 2 so as to read information written on a document.

The image forming portion 2 conveys a plurality of sheets S stacked on a sheet cassette 4 one by one in separation by means of a sheet roller 6 and separating/conveying rollers 7, and then, conveys them to an image forming process unit (i.e., a process cartridge) 9 through a conveying guide 8, as shown in FIG. 1.

The image forming process unit 9 is adapted to form an image (i.e., a toner image) by an electrophotographic system. Specifically, a charged photosensitive drum 10 serving as an image bearing member is illuminated with light by a laser scanner 11, and then, the image is developed with a toner, so that the resultant toner image is transferred onto the sheet S.

The sheet S having the toner image transferred from the photosensitive drum 10 is conveyed to a fixing unit 12, which fixes the image by the application of heat and pressure.

The sheet S having the image fixed thereto is switchably conveyed onto a face-up conveying path 14 or a switch-back conveying path 15, which reverses the sheet upside down, by a conveying path switching member 13.

The sheet conveyed onto the switch-back conveying path 15 is conveyed by switch-back conveying rollers 16 until the rear end of the sheet passes a switching member 17. Thereafter, the sheet is conveyed in a vertically reverse state in which the rear end heretofore serves as a fore end by the effect of the reverse of the switch-back conveying rollers 16. At this time, the reversed sheet is conveyed onto a face-down conveying path 18 by the switch of the switching member 17.

The face-up conveying path 14 and the face-down conveying path 18 are converged before discharge rollers 19. Both of the sheet guided on the face-up conveying path 14 and the sheet passing the face-down conveying path 18 from the switch-back conveying path 15 are discharged from the image forming portion 2 by the discharge rollers 19.

The image reading portion 3 includes a scanner unit 21 and an automatic document feeder (hereinafter abbreviated as "an ADF") 22, as shown in FIG. 1. The ADF 22 conveys a plurality of documents stacked on a document stack tray 23 one by one in separation by a document roller 24, so as to allow them to pass a document reading position 25, at which an optical carriage 27 in the scanner unit 21 is stationary. Moreover, the ADF 22 can be freely opened or closed rearward on a hinge (not shown) disposed at a rear portion of the apparatus, and therefore, opens or closes when the document is placed on a document base plate glass 26.

The scanner unit 21 is provided with the movable optical carriage 27, to read the information described on the document. The scanner unit 21 reads the information described on the document while the optical carriage 27 scans the document placed on the document base plate glass 26 in a horizontal direction, and then, optoelectronically transduces the information by a CCD 28. In addition, when is read the document in the above-described ADF 22, the optical carriage 27 stationary at the document reading position 25 reads the information described on the document being conveyed, as described above.

Subsequently, the sheet processing apparatus 1 will be described below in reference to FIGS. 1 to 5. The sheet processing apparatus 1 is provided with two upper stack trays 44 and 45, an intermediate stack portion 34, as a first stack portion, including joggers 51 and 52, and a lower stack tray 35, as shown in FIG. 1. In the intermediate stack portion 34, an aligning or binding processing can be selectively performed with respect to the sheet.

The intermediate stack portion 34 is adapted to temporarily stack thereon the sheet from the main body A of the image forming apparatus. As shown in FIG. 4, the intermediate stack portion 34 has an alignment reference wall 34*a* as a first abutment reference at an end upstream in a sheet conveyance direction. The intermediate stack portion 34 is disposed in parallel to the upper stack tray 44 and in the proximity of the lower portion of the upper stack tray 44. The intermediate stack portion includes the joggers 51 and 52 serving as aligning members for aligning the sheets. The joggers 51 and 52 are disposed downstream in the sheet conveyance direction of the intermediate stack portion 34 and in the proximity of the lower portion of the upper stack tray 44.

The lower stack tray 35 is disposed under the intermediate stack portion 34, and serves as a third stack portion, on which the sheet falls down from the jogger 51 or 52 in the intermediate stack portion 34.

The upper stack trays 44 and 45 serve as a second stack portion, on which the sheet received from the main body A of the image forming apparatus is directly stacked. As shown in FIG. 4, the upper stack trays 44 and 45 have stack reference walls 44*a* and 45*a* as a second abutment references at ends upstream in the sheet conveyance direction, respectively.

As shown in FIG. 1, the sheet received from the main body A of the image forming apparatus is selectively switched under guidance to a stapling conveying path 42 or an assorting conveying path 43 by a switching member 41 in the sheet processing apparatus 1.

First, explanation will be made on the case where the sheet is conveyed onto the stapling conveying path 42 by switching the switching member 41. The intermediate stack portion 34 for temporarily stacking the sheet thereon is located downstream of an intermediate conveying roller 31. Downstream of the intermediate stack portion 34 are disposed the joggers 51 and 52 for jogging the sheet in a direction perpendicular to the sheet conveyance direction and a drive 53 for driving the joggers 51 and 52. During the sheet alignment, an upper discharge roller 32 out of a pair of discharge rollers 32 and 33 is retreated upward in such a manner as not to interfere with the alignment. When the rear end of the sheet passes the intermediate conveying roller 31, the sheet is landed on the intermediate stack portion 34, to be then moved in a width direction perpendicular to the sheet conveyance direction by the joggers 51 and 52, and thus, is aligned in the width direction. Thereafter, the end of the sheet abuts against the alignment reference wall 34*a* by an aligning roller 36, so that the sheet is aligned in the sheet conveyance direction. This operation is repeated every time one piece of sheet is conveyed. When the last sheet is conveyed and aligned, the bundle of sheets is stapled at the upstream end thereof by a stapler 54. Thereafter, the bundle of sheets is discharged onto the stack tray 35 by the pair of discharge rollers 32 and 33. Moreover, the sheet conveyed onto the stapling conveying path 42 is discharged as it is onto the stack tray 35 by the pair of discharge rollers 32 and 33 without any aligning in a non-stapling mode.

Referring to FIG. 2, a description will be given below of the joggers 51 and 52. As shown in FIG. 2, the joggers 51 and 52 hold the side ends of the sheet S during the alignment, that is, align the sheet by their reciprocating motion in directions indicated by arrows a and b. After the bundle of sheets is stapled by the stapler, the jogger 51 is retreated in the direction indicated by the arrow a in FIG. 3 while the jogger 52 is retreated in the direction indicated by the arrow b in FIG. 3, so that they do not hold the side ends of the sheet S. As a consequence, the sheet S falls down on the stack tray 35 disposed downward while being discharged by the pair of discharge rollers 32 and 33. Here, the drive 53 allows the joggers 51 and 52 to make the reciprocating motion in the sheet width direction.

Next, explanation will be made on the case where the switching member 41 is switched, and the sheet is conveyed onto the assorting conveying path 43. As shown in FIG. 1, the sheet switched by the switching member 78 is conveyed by a pair of conveying rollers 47, to be then selectively switched to a first conveying path 48 or a second conveying path 49 under guidance. The sheet guided onto the first conveying path 48 is discharged onto the stack tray 44 by a pair of discharge rollers 38. In contrast, the sheet guided onto the second conveying path 49 is discharged onto the stack tray 45 by a pair of discharge rollers 39.

Subsequently, the relationship between the intermediate stack portion 34 and the stack tray 44 disposed above the intermediate stack portion 34 will be described in reference to FIG. 4. FIG. 4 shows the state in which the sheet having a maximum length is stacked on the intermediate stack portion 34 whereas the sheet having a minimum length is stacked on the stack tray 44 disposed above the intermediate stack portion 34. Here, although the sheet having the maximum length is exemplified by a sheet having an LGL size (360×216) whereas the sheet having the minimum length is exemplified by a sheet having an LTR size (about 280×216), the sizes of the sheets are not limited to these.

As shown in FIG. 4, the sheet on the intermediate stack portion 34 is held downstream thereof by the joggers 51 and 52 astride the pair of discharge rollers 32 and 33. The sheet held by the intermediate stack portion 34 and the joggers 51 and 52 abuts at the upstream end thereof against the alignment reference wall 34*a* by the above-described alignment. The jogger drive 53 is disposed above the joggers 51 and 52, and further, the stack tray 44 is located right above the jogger drive 53 in a vertical direction.

As shown in FIGS. 4 and 5, the stack tray 44 has such a length that the end of the sheet S held by the intermediate stack portion 34 and the joggers 51 and 52 downstream in the conveyance direction does not project, as viewed from above in the vertical direction.

In the meantime, the sheet already discharged on the stack tray 44 by the pair of discharge rollers 38 slides down upstream on the stack tray 44 by gravity, to thus abut against the stack reference wall 44*a*, as shown in FIG. 4. The positional relationship between the stack reference wall 44*a* of the stack tray 44 disposed above and the alignment reference wall 34*a* of the intermediate stack portion 34 is established such that the alignment reference wall 34*a* of the intermediate stack portion 34 is disposed upstream in the sheet conveyance direction more than the stack reference wall 44*a* of the stack tray 44. Specifically, the alignment reference wall 34*a* is deviated by a distance X in a direction along a sheet stack surface from the stack reference wall 44*a*. The alignment reference wall 34*a* projects from a vertical line passed through the stack reference wall 44*a*.

Moreover, a cutout 61 is formed at the stack tray 44 downstream in the sheet conveyance direction, to take out the stacked sheet S, as shown in FIG. 5. The cutout 61 is formed deeply to a position at which the tip of the sheet having the maximum length aligned by the intermediate stack portion 34 and the joggers 51 and 52 does not project, as viewed from above in the vertical direction. More particularly, the cutout 61 is formed in such a manner as to satisfy the equation: $Y=X-(\beta-\alpha)$, where Y represents the grasp margin amount of stacked sheet at the cutout 61; $\alpha$ represents the minimum length of the sheet to be stacked on the stack tray 44; and $\beta$ represents the maximum length of the sheet to be stacked on the intermediate stack portion 34. Since the cutout on the stack tray 44 is located at a position $(\alpha-Y)$ from the stack reference wall 44*a* in the direction along the sheet stack surface, the taking-out grasp margin Y can be secured even for the sheet having the minimum length. In other word, an end of the sheet, downstream in the sheet conveying direction, having a maximum length to be stacked on the intermediate stack portion 34 cannot project from a vertical line passed through an end of the cutout 61.

Incidentally, although the minimum length is the LTR size whereas the maximum length is the LGL size in the above description, the present invention can be applied to apparatuses for sheets having sizes other than the exemplified sizes by setting each of the values in such a manner as to satisfy the relationship represented by the above-described equation. In the example with the above-described sheet sizes, the grasp margin Y is 20 mm and the distance X is 100 mm.

Here, an angle $\theta 1$ with respect to the installation surface of the intermediate stack portion 34 is set within a range from about 15° to 40° inclusive of the joggers 51 and 52. In addition, an angle $\theta 2$ with respect to the installation surface of the stack tray 44 is set at about 30°. The relationship between these two angles is expressed by an angular difference, such that the intermediate stack portion 34 and the stack tray 44 are defined to be substantially parallel to each other within a range of 20° or less.

Although the description has been given of the relationship between the intermediate stack portion 34 and the stack tray 44 disposed above the intermediate stack portion 34 is expressed by a single step, it is not limited to this. In other words, there may be a plurality of steps.

As described above, the intermediate stack portion 34 and the stack tray 44 disposed above the intermediate stack portion 34 can be arranged in the proximity of each other by disposing the intermediate stack portion 34 and the stack tray 44 disposed right above the intermediate stack portion 34 at the installation surfaces thereof parallel to each other, thus achieving the miniaturization of the apparatus. Additionally, even if the stack tray 44 disposed above the intermediate stack portion 34 is short in the sheet conveyance direction, the sheet having the maximum length held by the intermediate stack portion 34 and the joggers 51 and 52 can be concealed from the stack tray 44 disposed above the intermediate stack portion 34, as viewed from above in the vertical direction. As a consequence, it is possible to reduce an erroneous access to the sheet on the intermediate stack portion while achieving the miniaturization of the apparatus.

Additionally, the stack tray 44 disposed above the intermediate stack portion 34 also serves as a cover for concealing the intermediate stack portion 34 inclusive of the joggers 51 and 52 disposed downward. Thus, the intermediate stack portion 34 and the stack tray 44 disposed above the intermediate stack portion 34 can be arranged more in the proximity of each other in comparison with a configuration in which a cover is independently disposed in the intermediate stack portion, and further, a cost of a cover can be reduced.

Second Embodiment

Subsequently, a description will be given below of a second embodiment in reference to FIGS. 6 to 8. Here, the schematic configurations of the main body A of the image forming apparatus and the sheet processing apparatus 1 are substantially the same as those in the above-described first embodiment, and therefore, the above descriptions can be applied.

Figure 6:
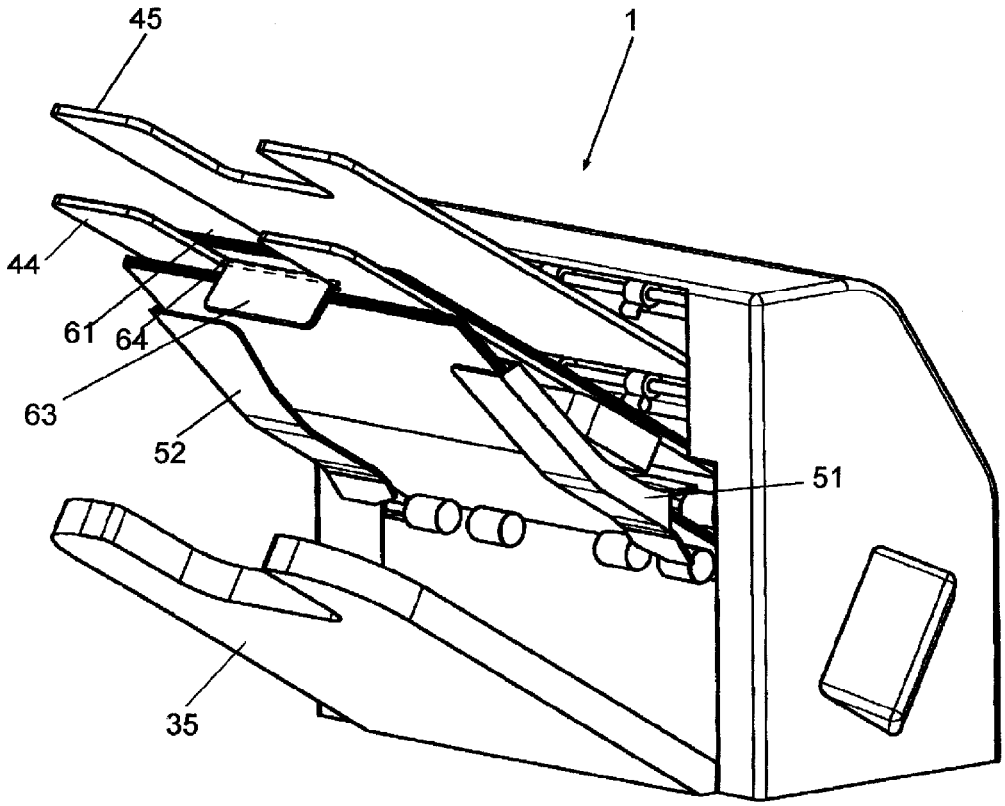
FIG. 6 is a perspective view showing a sheet processing apparatus in a second embodiment.
Figure 7:
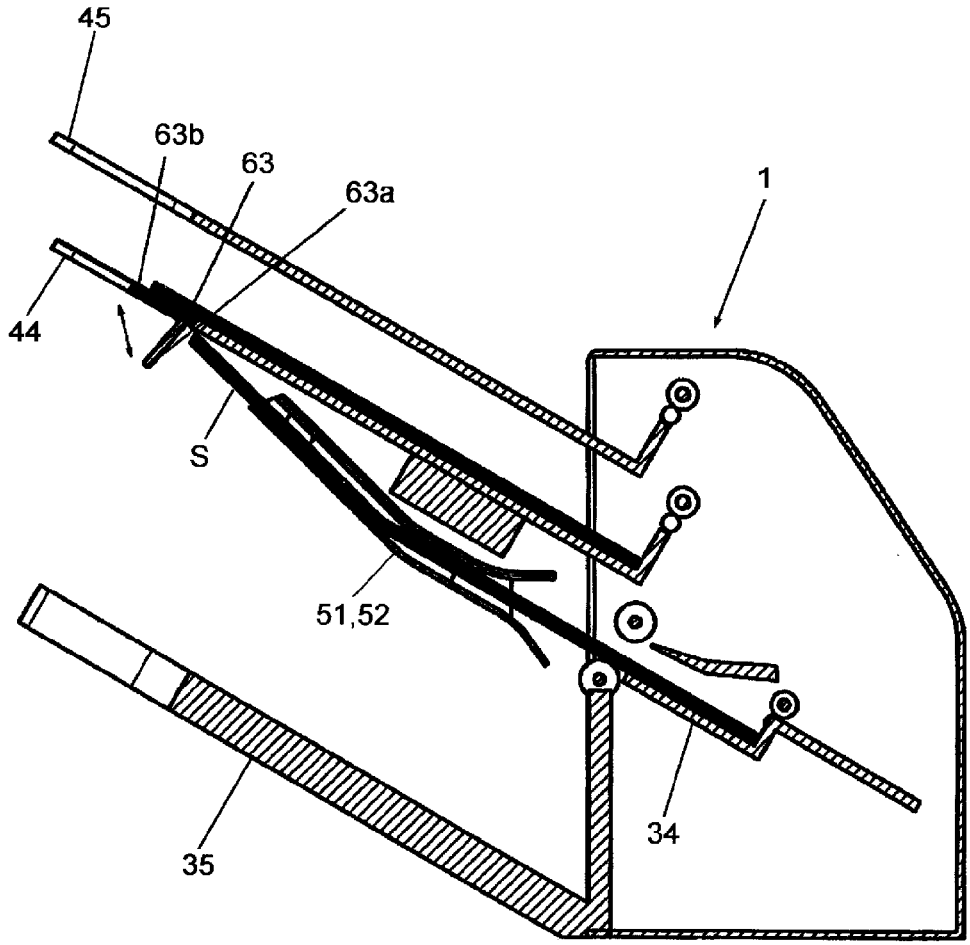
FIG. 7 is a cross-sectional view showing essential parts of the sheet processing apparatus in the second embodiment.
Figure 8:
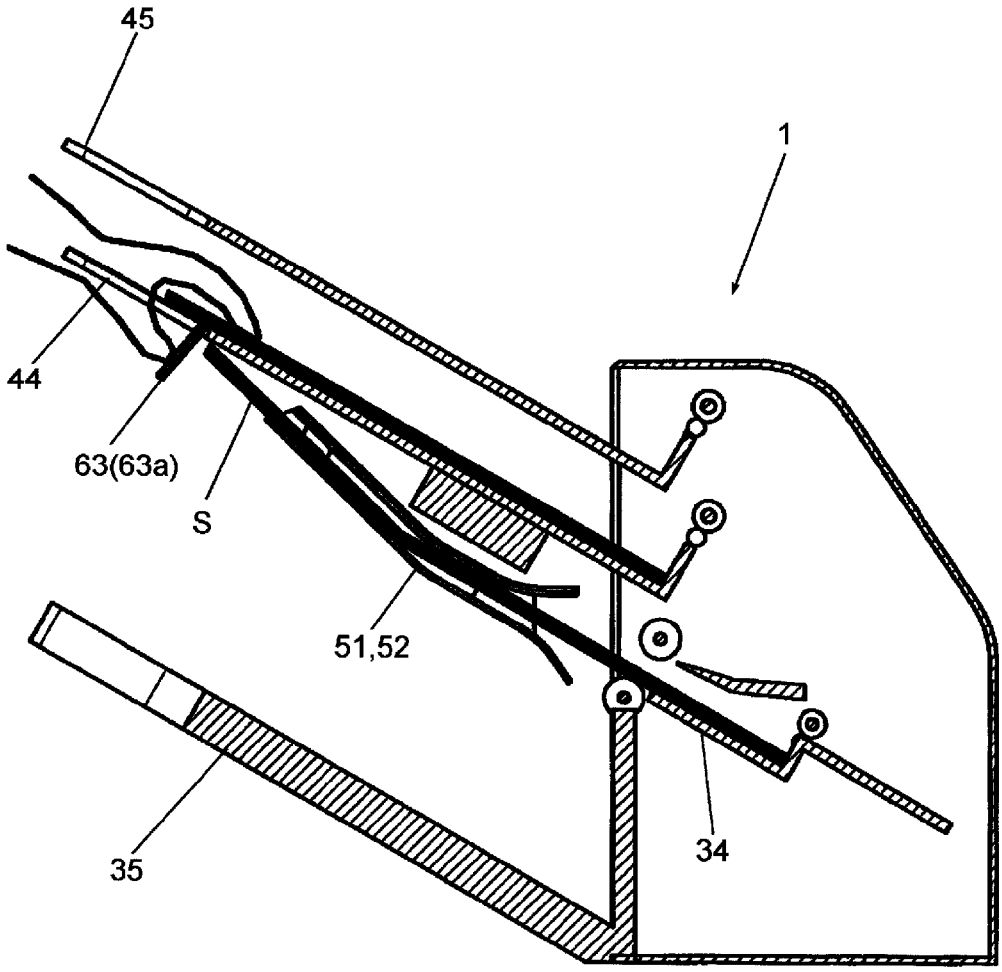
FIG. 8 is a cross-sectional view showing of the sheet processing apparatus in the second embodiment.

In the present preferred embodiment, as shown in FIGS. 6 and 7, a cover member (i.e., a rotating member) 63, which can be rotated on a rotational fulcrum 64, is disposed at the U-shaped cutout 61 in the stack tray 44. The cover member 63 can be rotated in directions indicated by a double-headed arrow between a downward position 63*a*, at which the tip of the cover member 63 is oriented downward in a vertical direction crossing a sheet stack surface, and a parallel position 63*b* parallel to the sheet stack surface. The cover member 63 is configured such that it cannot be rotated out of the rotation range by a stopper member (not shown).

The cover member 63 stays at the downward position 63*a* in a natural state by its own weight. That is to say, the downward position 63*a* is regarded as a home position of the cover member 63 at the time of the turning-on of a power source or during stand-by for a job. The cover member 63 covers the tip of the sheet S held on the intermediate stack portion 34 and the joggers 51 and 52 at the home position. In other words, the cover member 63 blocks a hand of a user in such a manner as to prevent any touch to the sheet being processed on the intermediate stack portion 34 and the joggers 51 and 52 when the sheet is taken out of the stack tray 44, as shown in FIG. 8.

Furthermore, since the cover member 63 is light in weight, it can be rotated by a very small force. As a consequence, when the sheet is discharged from, dropped from or stacked on the intermediate stack portion 34 and the joggers 51 and 52, the sheet to be discharged pushes the cover member 63 up to the parallel position 63*b*, to be thus discharged.

As described above, the rotatable cover member 63 is disposed in the cutout 61 formed in the stack tray 44 disposed above, so as to cover the tip of the sheet S held on the intermediate stack portion 34 and the joggers 51 and 52, thus preventing any touch of the hand of the user to the sheet being processed. Moreover, when the sheet on the intermediate stack portion 34 is discharged, the cover member 63 cannot interfere with the discharge since the cover member 63 can be readily rotated in a discharge direction by the sheet to be discharged.

Third Embodiment

Subsequently, a description will be given below of a third embodiment in reference to FIGS. 9 to 11. Here, the schematic configurations of the main body A of the image forming apparatus and the sheet processing apparatus 1 are substantially the same as those in the above-described first embodiment, and therefore, the above descriptions can be applied.

Figure 9:
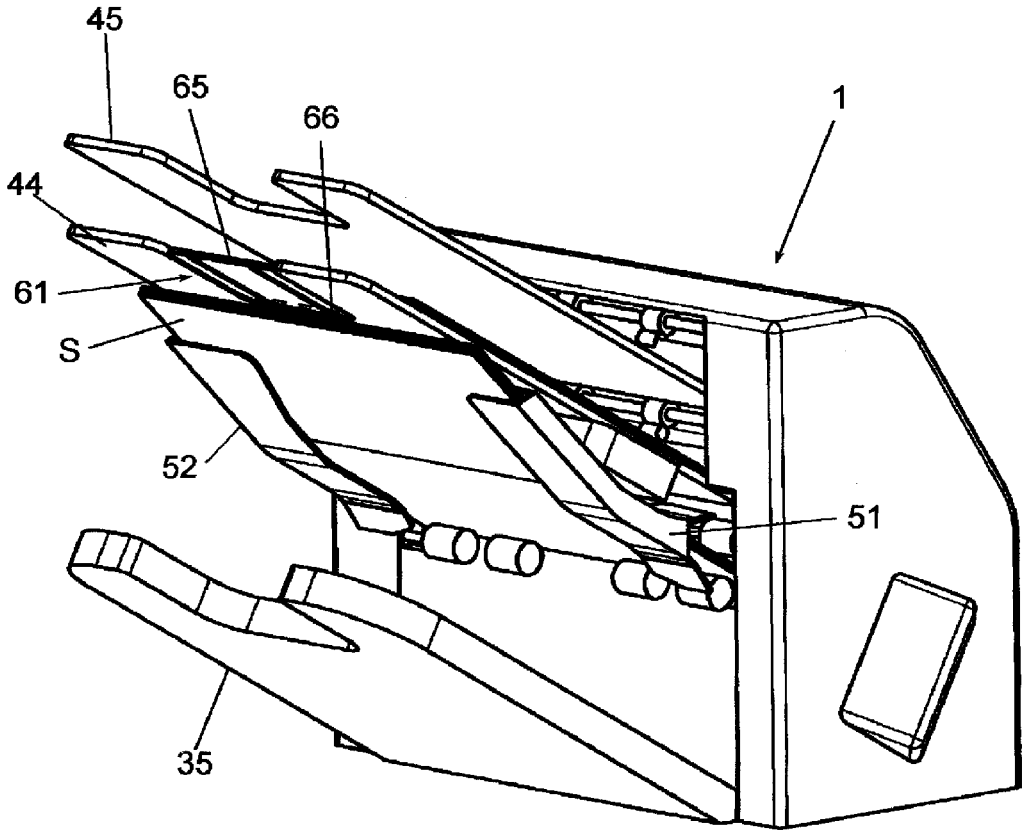
FIG. 9 is a perspective view showing a sheet processing apparatus in a third embodiment.
Figure 10:
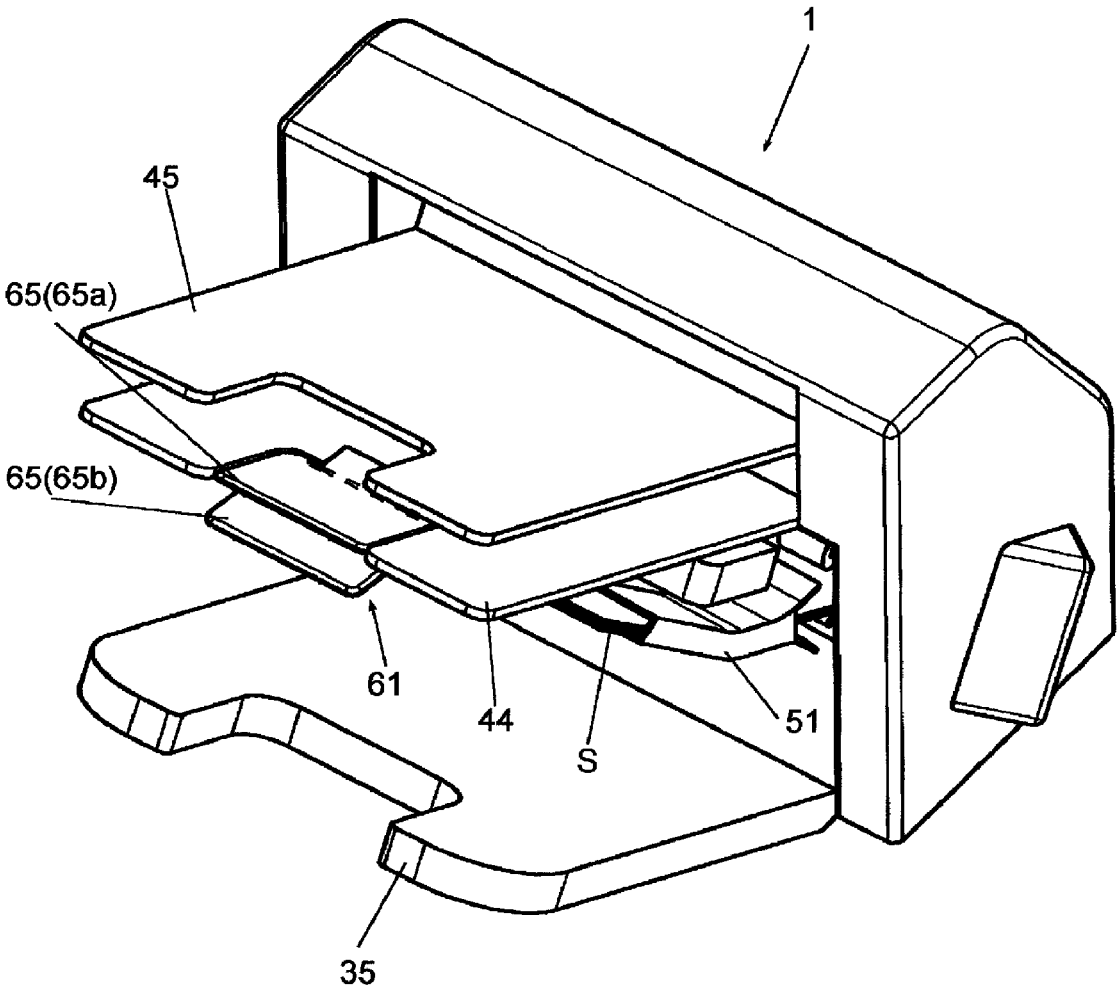
FIG. 10 is a perspective view showing the sheet processing apparatus in the third embodiment.

In the present preferred embodiment, as shown in FIGS. 9 and 10, an auxiliary tray (i.e., a rotating member) 65, which can be rotated on a rotational fulcrum 66, is disposed at a substantially U-shaped cutout 61 cut at the center of the tip of the stack tray 44. The auxiliary tray 65 can be rotated between a stack position 65*a*, on which the sheet is stacked, and a taking-out position 65*b*, from which the sheet is taken. The auxiliary tray 65 is configured such that it cannot be rotated out of the rotation range by a stopper member (not shown). The auxiliary tray 65 is normally energized at the stack position 65*a* by an energizing member such as a spring. A user pushes down the auxiliary tray 65, which is then rotated to the taking-out position 65*b*.

Figure 11:
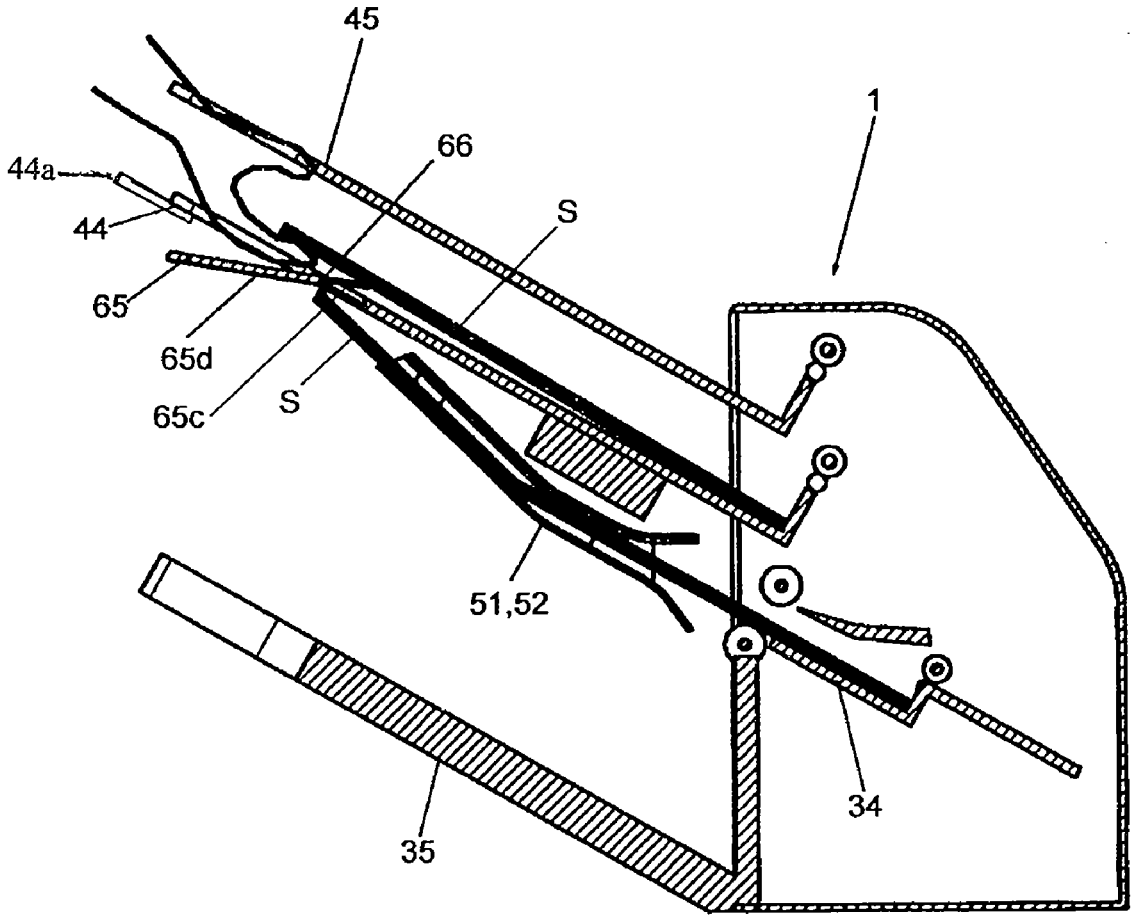
FIG. 11 is a schematic cross-sectional view showing the sheet processing apparatus in the third embodiment.

Upon the pushing-down of the auxiliary tray 65 when the user takes out the sheet, as shown in FIG. 11, a sheet grasp margin is generated. Therefore, the user can readily take out the sheet from the stack tray 44 by grasping the grasp margin. The rotational fulcrum 66 of the auxiliary tray 65 is located downstream of the tip of the sheet S being processed on the intermediate stack portion 34 and the joggers 51 and 52, as shown in FIG. 11.

Since the intermediate stack portion 34 inclusive of the joggers 51 and 52 is located in the proximity of the auxiliary tray 65, the rotational angle of the auxiliary tray 65 is made small. A stack surface of the auxiliary tray 65 is formed from downstream to upstream in the sheet conveyance direction astride the rotational fulcrum 66, and further, a tray end 65*c* at a portion upstream of the rotational fulcrum 66 is formed upstream beyond downstream at the end of the sheet S on the tray 65, as shown in FIG. 11. As a consequence, when the auxiliary tray 65 is rotated from the stack position 65*a* to the taking-out position 65*b*, the tray end 65*c* is rotated on the rotational fulcrum 66 in a direction in which the tray end 65*c* pushes up the sheet S. Thus, the user can readily insert his or her hand under the sheet even with a small rotating amount, so as to maintain a sheet taking-out property.

Moreover, a reverse surface 65*d* of the auxiliary tray 65 is not uneven but smooth in the sheet conveyance direction in such a manner that the sheet S being processed touches on the intermediate stack portion 34 and the joggers 51 and 52. As a consequence, even in the case where the sheet is taken out of the stack tray 44 during the discharge or fall after the sheet is processed, no sheet is jammed on the intermediate stack portion 34.

As described above, the auxiliary tray 65 covers the sheet S on the intermediate stack portion 34 when the sheet is taken out of the stack tray 44 disposed above, thereby more preventing any touch on the sheet S on the intermediate stack portion 34. In addition, the end of the stacked sheet can be lifted up by rotating the auxiliary tray 65, so that the sheet taking-out property can be maintained even with the small rotating amount. Additionally, the tip of the auxiliary tray 65 can be more suppressed from projecting toward the reverse surface of the stack tray 44 in comparison with the above-described second embodiment. The stack tray 44 disposed above can be located in the proximity of the intermediate stack portion 34 inclusive of the joggers 51 and 52, thus more miniaturizing the apparatus.

Other Embodiments

Although the above-described embodiments have been configured such that the stack tray 44 disposed above the intermediate stack portion 34 has the constant length in the sheet conveyance direction, the present invention is not limited to this. For example, the stack tray 44 disposed above the intermediate stack portion 34 may be configured such that the sheet stack surface includes an extending member 44*a* extensile downstream in the sheet conveyance direction. In this case, the extending member can extend up to a position at which the end of the sheet stacked on the intermediate stack portion 34 downstream in the sheet conveyance direction does not project, as viewed from above in the vertical direction. In other word, an end of the sheet, downstream in the sheet conveying direction, having a maximum length to be stacked on the intermediate stack portion 34 cannot project from a vertical line passed through an end of the extending member. With this configuration, the length of the stack tray 44 disposed above can be varied according to the length of the sheet stacked on the intermediate stack portion 34. Therefore, for the user who uses only a sheet of a small size, the apparatus can be miniaturized by putting away the extending member.

Moreover, although the above-described embodiments have been configured such that the two stack trays serve as the second stack portion which is disposed above the intermediate stack portion and stacks the sheet thereon, the present invention is not limited to this. The stack may be at least one: otherwise, it may be one or three or more.

Additionally, although the image forming apparatus has been exemplified by the copying machine in the above-described embodiments, the present invention is not limited to this. For example, the image forming apparatus may be other types of image forming apparatuses such as a scanner, a printer and a facsimile, or a composite machine configured by combining them with each other. The same effects can be produced by applying the present invention to sheet processing apparatuses for use in the image forming apparatuses.

In addition, although the sheet processing apparatus detachably attached to the image forming apparatus has been illustrated in the above-described embodiments, the present invention is not limited to this. For example, the image forming apparatus may integrally include a sheet processing apparatus. The same effects can be produced by applying the present invention to the sheet processing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-015798, filed Jan. 26, 2007, No. 2008-008741, filed Jan. 18, 2008 which are hereby incorporated by reference herein in their entirety.

What is claimed is:

1. A sheet processing apparatus comprising:

a first stack portion which stacks a conveyed sheet thereon with one end of the sheet abutting against a first abutment reference; and a second stack portion which is disposed right above the first stack portion in a vertical direction and stacks a conveyed sheet thereon with one end of the sheet abutting against a second abutment reference, wherein the first stack portion is provided with the second stack portion such that the first abutment reference projects from a vertical line passed through the second abutment reference, and wherein the second stack portion includes a cutout at a stack surface opposite side of the second abutment reference so as to take out the stacked sheet, and the other end, opposite side of one end, of the sheet having a maximum length to be stacked on the first stack portion cannot project to the cutout, and a rotating member which can rotate on a rotational fulcrum, at the cutout; the rotating member being capable of rotating between a downward direction, in which the end of the rotating member is oriented downward in the vertical direction, and a position along a sheet stack surface, so as to cover the other end of the sheet stacked on the first stack portion at the downward position.

2. A sheet processing apparatus according to claim 1, wherein the second stack portion has such a length that the other end, opposite side of one end, of the sheet having a maximum length to be stacked on the first stack portion cannot project from a vertical line passed through an opposite end of the second abutment reference.

3. A sheet processing apparatus according to claim 1, wherein the second stack portion includes an extending member which can extend a stack surface, the extending member being capable of extending to a position at which the other end, opposite side of one end, of the sheet having a maximum length to be stacked on the first stack portion cannot project from a vertical line passed through an end of the extending member.

4. A sheet processing apparatus according to claim 1, wherein the downward position is a home position of the rotating member at the time of the turning-on of a power source or during stand-by for a job.

5. A sheet processing apparatus according to claim 1, wherein a sheet stack surface of the first stack portion and a sheet stack surface of the second stack portion are defined to be substantially parallel to each other, and wherein an equation of $Y=X-(\beta-\alpha)$ is satisfied, where Y represents a grasp margin of the stacked sheet at the cutout, X represents a distance from the second abutment reference to the first abutment reference in a direction along the sheet stack surface, $\alpha$ represents a minimum length of the sheet to be stacked on the second stack portion, and $\beta$ represents a maximum length of the sheet to be stacked on the second stack portion.

6. A sheet processing apparatus comprising:

a first stack portion which stacks a conveyed sheet thereon with one end of the sheet abutting against a first abutment reference; and a second stack portion which is disposed right above the first stack portion in a vertical direction and stacks a conveyed sheet thereon with one end of the sheet abutting against a second abutment reference, wherein the first stack portion is provided with the second stack portion such that the first abutment reference projects from a vertical line passed through the second abutment reference, wherein the second stack portion includes:

a cutout at a stack surface opposite side of the second abutment reference so as to take out the stacked sheet, and the other end, opposite side of one end, of the sheet having a maximum length to be stacked on the first stack portion cannot project to the cutout, and a rotating member which can rotate on a rotational fulcrum at the cutout;

the rotating member being capable of rotating between a sheet stack position and a taking-out position.

7. A sheet processing apparatus according to claim 6, wherein the second stack portion has such a length that the other end, opposite side of one end, of the sheet having a maximum length to be stacked on the first stack portion cannot project from a vertical line passed through an opposite end of the second abutment reference.

8. A sheet processing apparatus according to claim 6, wherein the second stack portion includes an extending member which can extend a stack surface, the extending member being capable of extending to a position at which the other end, opposite side of one end, of the sheet having a maximum length to be stacked on the first stack portion cannot project from a vertical line passed through an end of the extending member.

9. A sheet processing apparatus according to claim 6, wherein the rotating member is disposed across the rotational fulcrum, and the rotating member is rotated in a direction, in which the rotating member pushes up the sheet on the rotational fulcrum, when the rotating member is rotated from the stack position to the taking-out position.

10. A sheet processing apparatus according to claim 6, wherein a sheet stack surface of the first stack portion and a sheet stack surface of the second stack portion are defined to be substantially parallel to each other, and wherein an equation of $Y=X-(\beta-\alpha)$ is satisfied, where Y represents a grasp margin of the stacked sheet at the cutout, X represents a distance from the second abutment reference to the first abutment reference in a direction along the sheet stack surface, $\alpha$ represents a minimum length of the sheet to be stacked on the second stack portion, and $\beta$ represents a maximum length of the sheet to be stacked on the second stack portion.

11. A sheet processing apparatus comprising:

a first stack portion which stacks thereon a conveyed sheet; and a second stack portion which is disposed right above the first stack portion in a vertical direction and stacks the conveyed sheet thereon, the second stack portion having such a length that an end of the sheet having a maximum length to be stacked on the first stack portion downstream in the sheet conveyance direction cannot project from a vertical line passed through an end of the second stack portion downstream in the sheet conveyance direction, wherein the second stack portion includes:

a cutout at a stack surface downstream in the sheet conveyance direction so as to take out the stacked sheet, and the end of the sheet having a maximum length to be stacked on the first stack portion downstream in the sheet conveyance direction cannot project to the cutout, and a rotating member which can rotate on a rotational fulcrum in a direction crossing the sheet conveyance direction, at the cutout;

the rotating member being capable of rotating between a downward direction, in which the end of the rotating member is oriented downward in the vertical direction, and a position along a sheet stack surface, so as to cover the end of the sheet stacked on the first stack portion at the downward position.

12. A sheet processing apparatus according to claim 11, further comprising:

a first abutment reference disposed at an end of the first stack portion upstream in the sheet conveyance direction and against which an end of the sheet is abutted; and a second abutment reference disposed at an end of the second stack portion upstream in a sheet conveyance direction and against which an end of the sheet is abutted, wherein the first abutment reference is disposed more upstream in the sheet conveyance direction than a vertical line passed through the second abutment reference.

13. A sheet processing apparatus according to claim 11, wherein the second stack portion includes an extending member which can extend a stack surface downstream in the sheet conveyance direction, the extending member being capable of extending to a position at which the end of the sheet having a maximum length to be stacked on the first stack portion downstream in the sheet conveyance direction cannot project from a vertical line passed through an end of the extending member.

14. A sheet processing apparatus according to claim 11, wherein the downward position is a home position of the rotating member at the time of the turning-on of a power source or during stand-by for a job.

15. A sheet processing apparatus according to claim 11, wherein a sheet stack surface of the first stack portion and a sheet stack surface of the second stack portion are defined to be substantially parallel to each other, and wherein an equation of $Y=X-(\beta-\alpha)$ is satisfied, where Y represents a grasp margin of the stacked sheet at the cutout, X represents a distance from the second abutment reference to the first abutment reference in a direction along the sheet stack surface, $\alpha$ represents a minimum length of the sheet to be stacked on the second stack portion, and $\beta$ represents a maximum length of the sheet to be stacked on the second stack portion.

16. A sheet processing apparatus comprising:

a first stack portion which stacks thereon a conveyed sheet; and a second stack portion which is disposed right above the first stack portion in a vertical direction and stacks the conveyed sheet thereon, the second stack portion having such a length that an end of the sheet having a maximum length to be stacked on the first stack portion downstream in the sheet conveyance direction cannot project from a vertical line passed through an end of the second stack portion downstream in the sheet conveyance direction, wherein the second stack portion includes a cutout at a stack surface downstream in the sheet conveyance direction so as to take out the stacked sheet, and the end of the sheet having a maximum length to be stacked on the first stack portion downstream in the sheet conveyance direction cannot project to the cutout, and a rotating member which can rotate on a rotational fulcrum in a direction crossing the sheet conveyance direction, at the cutout;

the rotating member being capable of rotating between a sheet stack position and a taking-out position.

17. A sheet processing apparatus according to claim 16, further comprising:

a first abutment reference disposed at an end of the first stack portion upstream in the sheet conveyance direction and against which an end of the sheet is abutted; and a second abutment reference disposed at an end of the second stack portion upstream in a sheet conveyance direction and against which an end of the sheet is abutted, wherein the first abutment reference is disposed more upstream in the sheet conveyance direction than a vertical line passed through the second abutment reference.

18. A sheet processing apparatus according to claim 16, wherein the second stack portion includes an extending member which can extend a stack surface downstream in the sheet conveyance direction, the extending member being capable of extending to a position at which the end of the sheet having a maximum length to be stacked on the first stack portion downstream in the sheet conveyance direction cannot project from a vertical line passed through an end of the extending member.

19. A sheet processing apparatus according to claim 16, wherein the rotating member is disposed from downstream to upstream in the sheet conveyance direction across the rotational fulcrum, a upstream portion of the rotational fulcrum is disposed more upstream than downstream of the end of the stacked sheet, and thus, the rotating member is rotated in a direction, in which the upstream portion pushes up the sheet on the rotational fulcrum, when the rotating member is rotated from the stack position to the taking-out position.

20. A sheet processing apparatus according to claim 16, wherein a sheet stack surface of the first stack portion and a sheet stack surface of the second stack portion are defined to be substantially parallel to each other, and wherein an equation of $Y=X-(\beta-\alpha)$ is satisfied, where Y represents a grasp margin of the stacked sheet at the cutout, X represents a distance from the second abutment reference to the first abutment reference in a direction along the sheet stack surface, $\alpha$ represents a minimum length of the sheet to be stacked on the second stack portion, and $\beta$ represents a maximum length of the sheet to be stacked on the second stack portion.

21. An image forming apparatus comprising:

an image forming portion which forms an image on a sheet; and a sheet processing apparatus which can selectively perform processing with respect to the sheet having the image formed thereon;

wherein the sheet processing apparatus includes:

a first stack portion which stacks thereon a conveyed sheet with one end of the sheet abutting against a first abutment reference; and a second stack portion which is disposed right above the first stack portion in a vertical direction and stacks a conveyed sheet thereon with one end of the sheet abutting against a second abutment reference, wherein the first stack portion is provided with the second stack portion such that the first abutment reference projects from a vertical line passed through the second abutment reference, wherein the second stack portion includes:

a cutout at a stack surface opposite side of the second abutment reference so as to take out the stacked sheet, and the other end, opposite side of one end, of the sheet having a maximum length to be stacked on the first stack portion cannot project to the cutout, and a rotating member which can rotate on a rotational fulcrum, at the cutout;

the rotating member being capable of rotating between a downward direction, in which the end of the rotating member is oriented downward in the vertical direction, and a position along a sheet stack surface, so as to cover the other end of the sheet stacked on the first stack portion at the downward position.

22. An image forming apparatus comprising:

an image forming portion which forms an image on a sheet; and a sheet processing apparatus which can selectively perform processing with respect to the sheet having the image formed thereon;

wherein the sheet processing apparatus includes:

a first stack portion which stacks thereon a conveyed sheet with one end of the sheet abutting against a first abutment reference; and a second stack portion which is disposed right above the first stack portion in a vertical direction and stacks a conveyed sheet thereon with one end of the sheet abutting against a second abutment reference, wherein the first stack portion is provided with the second stack portion such that the first abutment reference projects from a vertical line passed through the second abutment reference, wherein the second stack portion includes:

a cutout at a stack surface opposite side of the second abutment reference so as to take out the stacked sheet, and the other end, opposite side of one end, of the sheet having a maximum length to be stacked on the first stack portion cannot project to the cutout, and a rotating member which can rotate on a rotational fulcrum at the cutout;

the rotating member being capable of rotating between a sheet stack position and a taking-out position.

23. An image forming apparatus comprising:

an image forming portion which forms an image on a sheet; and a sheet processing apparatus which can selectively perform processing with respect to the sheet having the image formed thereon;

wherein the sheet processing apparatus includes:

a first stack portion which stacks thereon a conveyed sheet; and a second stack portion which is disposed right above the first stack portion in a vertical direction and stacks the conveyed sheet thereon, the second stack portion having such a length that an end of the sheet having a maximum length to be stacked on the first stack portion downstream in the sheet conveyance direction cannot project from a vertical line passed through an end of the second stack portion downstream in the sheet conveyance direction, wherein the second stack portion includes:

a cutout at a stack surface downstream in the sheet conveyance direction so as to take out the stacked sheet, and the end of the sheet having a maximum length to be stacked on the first stack portion downstream in the sheet conveyance direction cannot project to the cutout, and a rotating member which can rotate on a rotational fulcrum in a direction crossing the sheet conveyance direction, at the cutout;

the rotating member being capable of rotating between a downward direction, in which the end of the rotating member is oriented downward in the vertical direction, and a position along a sheet stack surface, so as to cover the end of the sheet stacked on the first stack portion at the downward position.

24. An image forming apparatus comprising:

an image forming portion which forms an image on a sheet; and a sheet processing apparatus which can selectively perform processing with respect to the sheet having the image formed thereon;

wherein the sheet processing apparatus includes:

a first stack portion which stacks thereon a conveyed sheet; and a second stack portion which is disposed right above the first stack portion in a vertical direction and stacks the conveyed sheet thereon, the second stack portion having such a length that an end of the sheet having a maximum length to be stacked on the first stack portion downstream in the sheet conveyance direction cannot project from a vertical line passed through an end of the second stack portion downstream in the sheet conveyance direction, wherein the second stack portion includes a cutout at a stack surface downstream in the sheet conveyance direction so as to take out the stacked sheet, and the end of the sheet having a maximum length to be stacked on the first stack portion downstream in the sheet conveyance direction cannot project to the cutout, and a rotating member which can rotate on a rotational fulcrum in a direction crossing the sheet conveyance direction, at the cutout;

the rotating member being capable of rotating between a sheet stack position and a taking-out position.

* * * * *